US010352604B2

(12) United States Patent
Zha

(10) Patent No.: US 10,352,604 B2
(45) Date of Patent: Jul. 16, 2019

(54) SYSTEM FOR CONTROLLING A REFRIGERATION SYSTEM WITH A PARALLEL COMPRESSOR

(71) Applicant: Heatcraft Refrigeration Products LLC, Stone Mountain, GA (US)

(72) Inventor: Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 13 days.

(21) Appl. No.: 15/370,439

(22) Filed: Dec. 6, 2016

(65) Prior Publication Data

US 2018/0156510 A1 Jun. 7, 2018

(51) Int. Cl.
*F25B 1/10* (2006.01)
*F25B 5/02* (2006.01)
(Continued)

(52) U.S. Cl.
CPC ..... *F25B 49/02* (2013.01); *F25B 1/10* (2013.01); *F25B 5/02* (2013.01); *F25B 9/008* (2013.01);
(Continued)

(58) Field of Classification Search
CPC ..... F25B 5/02; F25B 2400/075; F25B 49/02; F25B 2500/26; F25B 2600/0261;
(Continued)

(56) References Cited

U.S. PATENT DOCUMENTS 2,676,148 A * 4/1954 Iler ..... C10M 5/00 508/136
4,787,211 A * 11/1988 Shaw ..... F25B 1/10 417/248
(Continued)

FOREIGN PATENT DOCUMENTS

EP 3 064 866 A1 9/2016
WO WO 2006/022829 A1 3/2006

OTHER PUBLICATIONS

How to retrofit an ageing HFC system with transcritical CO2 Transcritical CO, Jan. 5, 2016 (Year: 2016).*
(Continued)

*Primary Examiner* — Frantz F Jules
*Assistant Examiner* — Nelson J Nieves
(74) *Attorney, Agent, or Firm* — Baker Botts L.L.P.

(57) ABSTRACT

An improved system, method, and controller for a refrigeration system is provided. The improved system, method, and controller operates the refrigeration system in a manner that extends the operation of a parallel compressor relative to the operation of a parallel compressor in a conventional refrigeration system. The improved method includes determining whether a parallel compressor of the refrigeration system is operational, and if operational, directing refrigerant discharged from a first compressor of the refrigeration system to the parallel compressor. The first compressor of the refrigeration system is operable to compress refrigerant discharged from a first refrigeration case, the second compressor is operable to compress refrigerant discharged from
(Continued)

a second refrigeration case, and the parallel compressor, when operational, is operable to provide parallel compression for the second compressor.

19 Claims, 3 Drawing Sheets

(51) Int. Cl.
*F25B 9/00* (2006.01)
*F25B 41/04* (2006.01)
*F25B 49/02* (2006.01)

(52) U.S. Cl.
CPC ..... *F25B 41/04* (2013.01); *F25B 49/022* (2013.01); *F25B 2309/061* (2013.01); *F25B 2400/075* (2013.01); *F25B 2500/26* (2013.01); *F25B 2500/27* (2013.01); *F25B 2600/0261* (2013.01); *F25B 2600/2501* (2013.01); *F25B 2700/2106* (2013.01)

(58) Field of Classification Search
CPC ..... F25B 2309/061; F25B 2500/27; F25B 2600/2501; F25B 1/10
See application file for complete search history.

(56) References Cited

U.S. PATENT DOCUMENTS 5,235,820 A * 8/1993 Radermacher ..... F25B 1/10 62/114
5,522,233 A * 6/1996 Nares ..... F04B 39/04 417/228
6,276,148 B1 * 8/2001 Shaw ..... F04B 9/04 237/2 B
6,330,804 B1 * 12/2001 Uno ..... F04C 23/001 62/175
7,409,833 B2 * 8/2008 Unger ..... F25B 1/02 417/254
2005/0138936 A1 * 6/2005 Dub ..... F25B 5/02 62/81
2006/0112705 A1 * 6/2006 Jin ..... F25B 49/022 62/228.5
2008/0289349 A1 * 11/2008 Landers ..... F25B 49/025 62/228.5
2009/0260389 A1 * 10/2009 Dube ..... C09K 5/041 62/430
2009/0288432 A1 * 11/2009 Lifson ..... F25B 5/02 62/115
2010/0139312 A1 * 6/2010 Takegami ..... F25B 13/00 62/498
2010/0154465 A1 * 6/2010 Sakae ..... F25B 1/10 62/470
2010/0251738 A1 * 10/2010 Takegami ..... F25B 41/046 62/228.5
2010/0300135 A1 * 12/2010 Otake ..... F24D 17/02 62/335
2013/0145781 A1 * 6/2013 Liu ..... F25B 1/02 62/115
2013/0180276 A1 * 7/2013 Choi ..... F25B 7/00 62/190
2013/0283833 A1 * 10/2013 Huff ..... F25B 1/10 62/115
2014/0208785 A1 * 7/2014 Wallace ..... F25B 9/008 62/115
2015/0276276 A1 * 10/2015 Goel ..... F25B 49/022 62/79
2015/0345835 A1 * 12/2015 Martin ..... F25B 7/00 62/238.3
2016/0047576 A1 * 2/2016 Ko ..... F25B 41/04 62/86
2016/0138847 A1 * 5/2016 Zimmermann ..... F25D 3/12 62/384
2016/0305702 A1 * 10/2016 Nikaido ..... F25B 49/02
2017/0159977 A1 * 6/2017 Hellmann ..... F25B 1/10
2017/0205120 A1 * 7/2017 Ali ..... F25B 9/008
2017/0328604 A1 * 11/2017 Fredslund ..... F25B 9/008
2018/0156513 A1 * 6/2018 Javerschek ..... F25B 1/10

OTHER PUBLICATIONS

Extended Search Report in European Patent Application No. 17204080.0-1008, dated Jan. 30, 2018 (dated Feb. 26, 2018), 8 pages.

* cited by examiner

SYSTEM FOR CONTROLLING A REFRIGERATION SYSTEM WITH A PARALLEL COMPRESSOR

TECHNICAL FIELD

This disclosure relates generally to an refrigeration system. More specifically, this disclosure relates to a system for controlling a refrigeration system with a parallel compressor.

BACKGROUND

Refrigeration systems can be used to regulate the environment within an enclosed space. Various types of refrigeration systems, such as residential and commercial, may be used to maintain cold temperatures within an enclosed space such as a refrigerated case. To maintain cold temperatures within refrigerated cases, refrigeration systems control the temperature and pressure of refrigerant as it moves through the refrigeration system. When controlling the temperature and pressure of the refrigerant, refrigeration systems consume power. It is generally desirable to operate refrigeration systems efficiently in order to avoid wasting power.

SUMMARY OF THE DISCLOSURE

According to one embodiment, a method for a refrigeration system includes determining whether a parallel compressor of the refrigeration system is operational, directing refrigerant discharged from a first compressor of the refrigeration system to a second compressor of the refrigeration system if the parallel compressor is not operational, and directing the refrigerant discharged from the first compressor to the parallel compressor if the parallel compressor is operational. The first compressor of the refrigeration system is operable to compress refrigerant discharged from a first refrigeration case, the second compressor is operable to compress refrigerant discharged from a second refrigeration case, and the parallel compressor, when operational, is operable to provide parallel compression for the second compressor.

Certain embodiments may provide one or more technical advantages. For example, an embodiment of the present disclosure may result in more efficient operation of refrigeration system. As another example, an embodiment of the present disclosure may permit a parallel compressor of a refrigeration system to remain in operation for a longer period of time relative to refrigeration systems that include a parallel compressor in the traditional configuration. As yet another example, an embodiment of the present invention may reduce the number of on/off cycles of the parallel compressor relative to refrigeration systems that include a parallel compressor in the traditional configuration, thereby improving the stability of the refrigeration system. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
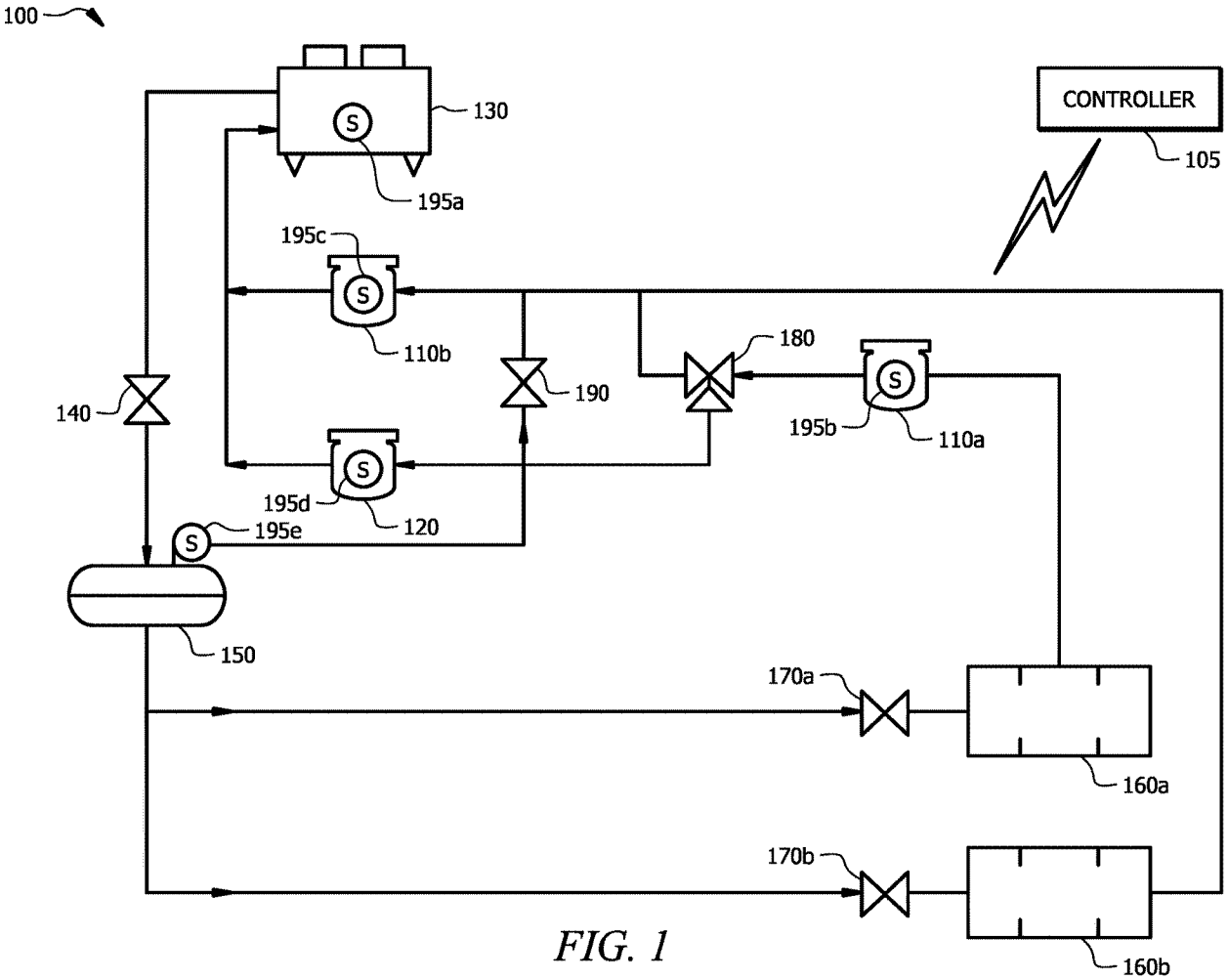
FIG. 1 illustrates an example refrigeration system according to certain embodiments of the present disclosure.

Embodiments of the present disclosure and its advantages are best understood by referring to FIGS. 1 through 4 of the drawings, like numerals being used for like and corresponding parts of the various drawings.

A refrigeration system can be used to maintain cool temperatures within an enclosed space, such as a refrigerated case for storing food, beverages, etc. This disclosure contemplates a configuration of a refrigeration system that may provide energy-efficient benefits. One way to improve the efficiency of a refrigeration system is to include a parallel compressor. Parallel compression refers to the inclusion and operation of at least one parallel compressor in a refrigeration system. Generally, a parallel compressor operates "in parallel" to another compressor of the refrigeration system, thereby reducing the amount of compression that the other compressor needs to be apply to refrigerant circulating through the refrigeration system. Inclusion of an operational parallel compressor may be associated with certain energy efficiency benefits. For example, including a parallel compressor in a transcritical refrigeration system circulating $CO_2$ refrigerant may improve efficiency of the refrigeration system by 10-15%. Accordingly, a refrigeration system may realize efficiency benefits when the parallel compressor is operational. However, the parallel compressor may not always be operational.

Generally, a parallel compressor is operational only when the flow rate of refrigerant into the parallel compressor is greater than an operation threshold (e.g., about 50% of design flow rate). The flow rate to the parallel compressor may fluctuate based on system load and/or ambient temperature. As a result, a reduction in system load and/or ambient temperature of the environment of the refrigeration system may cause the flow rate to drop below the operation threshold, in turn causing the parallel compressor to turn off. The refrigeration system does not realize the efficiency benefits of the parallel compressor when the parallel compressor is not operational.

In a refrigeration system that includes a parallel compressor in the traditional configuration, the parallel compressor receives refrigerant in the form of flash gas from a flash tank. When the system load and/or the ambient temperature of the environment of the refrigeration system is low, the parallel compressor may not be operational because the flow rate of refrigerant from the flash tank may fall below the operation threshold. Stated differently, the parallel compressor may not be operational when (1) an ambient temperature of the environment surrounding the refrigeration system falls below a temperature threshold; and/or (2) a load of the refrigeration system is below a load threshold. As a result, the parallel compressor may frequently cycle between on and off. For example, a parallel compressor is not operational when the system load or the ambient temperature is relatively low (e.g., when the system load is 80% and the ambient temperature is below 24° C. or when the ambient temperature falls below 22° C.) because the flow rate of refrigerant to the parallel compressor falls below the operation threshold.

This disclosure contemplates a configuration of a refrigeration system that extends the duration of operation of a parallel compressor in a refrigeration system relative to the traditional configuration, thereby providing efficiency benefits. As an example, suppose that a flow rate of refrigerant must be greater than X in order for the parallel compressor to remain operational. In a traditional configuration, this would mean that the parallel compressor would not be operational if the flow rate of refrigerant from the flash tank was less than X. By contrast, embodiments of the present disclosure enable the parallel compressor to receive refrigerant not only from the flash tank, but also from another compressor of the refrigeration system. As a result, even if the flow rate of refrigerant from the flash tank falls below X, in certain conditions, the refrigerant from the other compressor may provide sufficient flow such that the total flow rate to the parallel compressor exceeds X and the parallel compressor can remain operational.

Accordingly, certain embodiments provide for optimizing power usage by increasing the duration of operation for a parallel compressor of a refrigeration system relative to a refrigeration system that includes a parallel compressor in the traditional configuration. Additionally, certain embodiments provide for reducing the number of on and off cycles of a parallel compressor relative to a refrigeration system including a parallel compressor in the traditional configuration. This disclosure also contemplates a refrigeration system having an increased flow rate of a parallel compressor relative to a refrigeration system including a parallel compressor in the traditional configuration.

Figure 2:
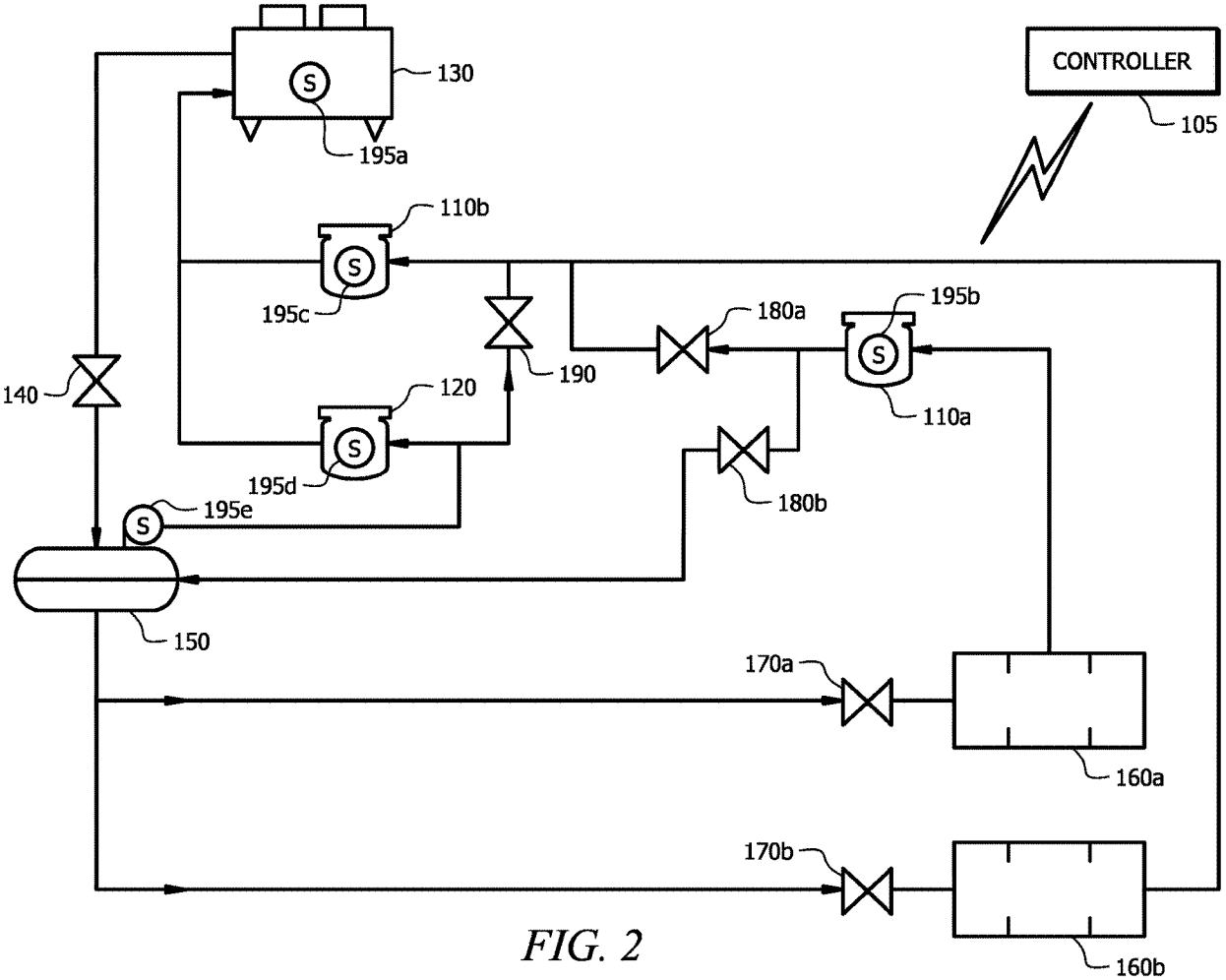
FIG. 2 illustrates an example refrigeration system according to certain other embodiments of the present disclosure.

FIGS. 1 and 2 illustrate examples of a transcritical refrigeration system. A transcritical refrigeration system 100 may include a controller 105, at least two compressors 110, a parallel compressor 120, a gas cooler 130, an expansion valve 140, a flash tank 150, one or more evaporator valves 170 corresponding to one or more evaporators 160, at least one compressor valve 180, and a flash gas valve 190. As depicted in FIGS. 1 and 2, refrigeration system 100 includes two compressors (a first compressor 110*a* and a second compressor 110*b*), two evaporators 180 (a first evaporator 160*a* and a second evaporator 160*b*), and two evaporator valves 170 (a first valve 170*a* and a second valve 170*b*).

First valve 170*a* may be configured to discharge low-temperature (e.g., −29° C.) liquid refrigerant to first evaporator 160*a* (also referred to herein as low-temperature ("LT") case 160*a*). Second valve 170*b* may be configured to discharge medium-temperature (e.g., −7° C.), liquid refrigerant to evaporator 160*b* (also referred to herein as medium-temperature ("MT") case 160*b*). In certain embodiments, LT case 160*a* and MT case 160*b* may be installed in a grocery store and may be used to store frozen food and refrigerated fresh food, respectively. In some embodiments, first evaporator 160*a* may be configured to discharge warm refrigerant vapor to first compressor 110*a* and second evaporator 160*b* may be configured to discharge warm refrigerant vapor to a second compressor 110*b*. In such a refrigeration system, first compressor 110*a* compresses the warmed refrigerant from the LT case 160*a* and discharges the compressed refrigerant to parallel compressor 120 and/or second compressor 110*b* (depending on the configuration of the at least one compressor valve 180).

When the one or more compressor valves 180 are configured such that first compressor 110*a* discharges the compressed refrigerant to second compressor 110*b*, the compressed refrigerant discharged from first compressor 110*a* joins the warm refrigerant discharged from MT case 160*b* and flows to second compressor 110*b* for compression. The refrigerant discharged from second compressor 110*b* may then be discharged to gas cooler 130 for cooling, which in turn is discharged to expansion valve 140 which discharges mixed-state refrigerant (e.g., refrigerant is discharged in both vapor and liquid form). The mixed-state refrigerant then flows through flash tank 150 where it is separated into vapor (i.e., flash gas) and liquid refrigerant. The liquid refrigerant flows from the flash tank to one or more of the cases 160 through evaporator valves 170 and the cycle begins again.

Both the disclosed configuration and the traditional configuration of a transcritical refrigeration system with a parallel compressor 120 include a connection from flash tank 150 to parallel compressor 120 and a connection from flash tank 150 to a compressor 110. In these configurations, flash tank 150 discharges flash gas (refrigerant vapor) to parallel compressor 120 for compression when parallel compressor 120 is operational and discharges flash gas to compressor 110*b* (by opening/closing valve 190) when parallel compressor 120 is not operational. As explained above, refrigeration system 100 may reduce its energy usage by 10-15% (relative to refrigeration systems without a parallel compressor) when parallel compressor is operational. As also explained above, the traditional configuration continuously turns off and on as the flow rate fluctuates (e.g., based on the system load and/or the ambient temperature).

Unlike the disclosed configuration depicted in FIGS. 1 and 2, the traditional configuration does not include a connection from first compressor 110*a* to parallel compressor 120. This disclosure recognizes that discharging refrigerant from first compressor 110*a* to parallel compressor 120 may extend the duration of operation for parallel compressor 120 because it increases the flow rate of refrigerant to the compressor above the operation threshold. As a result, a refrigeration system 100 including the disclosed configuration may save additional energy relative to a refrigeration system 100 with a parallel compressor in the traditional configuration.

In some embodiments, refrigeration system 100 may be configured to circulate natural refrigerant such as a hydrocarbon (HC) like carbon dioxide ($CO_2$), propane ($C_3H_8$), isobutane ($C_4H_{10}$), water ($H_2O$), and air. Natural refrigerants may be associated with various environmentally conscious benefits (e.g., they do not contribute to ozone depletion and/or global warming effects). This disclosure makes reference to several example temperatures and pressures throughout and one of ordinary skill will recognize that such referenced temperatures and pressures may be sufficient for refrigeration systems circulating a particular refrigerant and may not be sufficient for refrigeration systems circulating other refrigerants. The example temperatures and pressures provided herein are tailored to a transcritical refrigeration system (i.e., a refrigeration system in which the heat rejection process occurs above the critical point) comprising a gas cooler and circulating the natural refrigerant $CO_2$.

Figure 3:
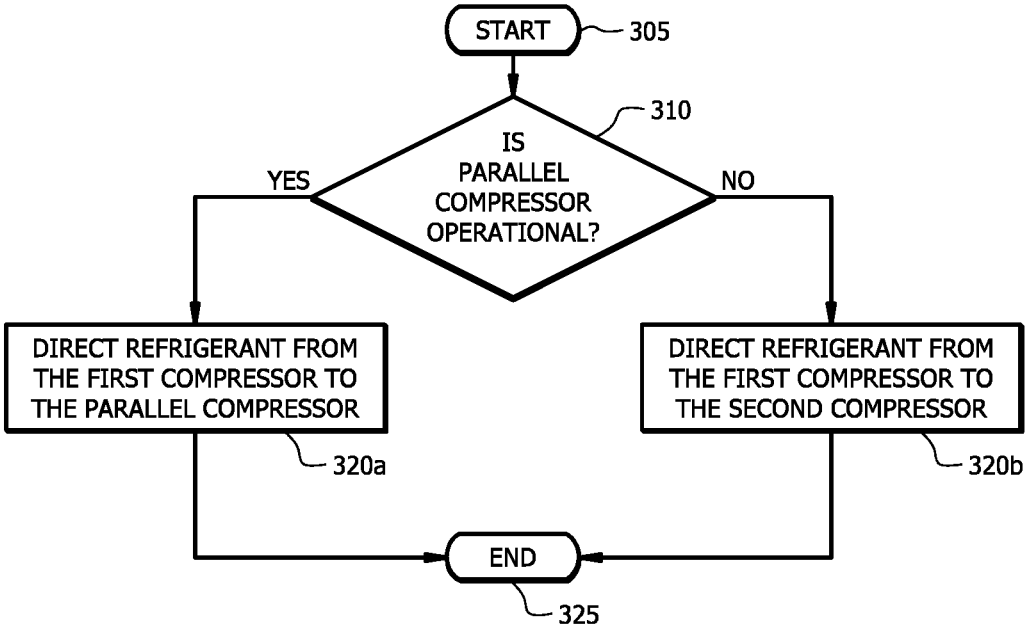
FIG. 3 is a flow chart illustrating a method of operation for a refrigeration system, according to certain embodiments of the present disclosure.
Figure 4:
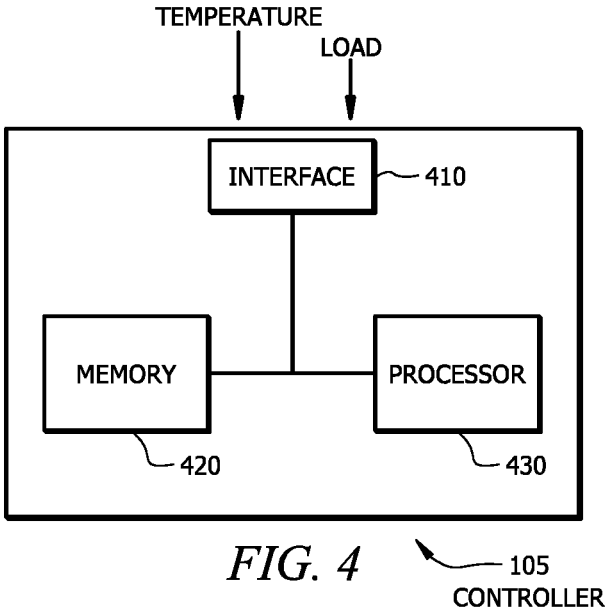
FIG. 4 illustrates an example of a controller of a refrigeration system, according to certain embodiments.

As will be described in more detail below, FIGS. 1 and 2 illustrate different embodiments of a refrigeration system configuration that extends the operation cycle of a parallel compressor of the refrigeration system relative to the duration of operation of a parallel compressor of a refrigeration system having a traditional configuration. FIG. 3 illustrates a method of operating a refrigeration system having a disclosed configuration and FIG. 4 illustrates a controller operable to execute the method of FIG. 3. In general, this disclosure recognizes discharging refrigerant from a first compressor to a parallel compressor when the parallel compressor is operational. In doing so, the parallel compressor may operate longer than it would in a refrigeration system wherein the first compressor does not discharge to the parallel compressor. As a result, the refrigeration system may be able to operate using less energy than it would otherwise use.

Refrigeration system 100 may include at least one controller 105 in some embodiments. Controller 105 may be configured to direct the operations of refrigeration system 100. Controller 105 may be communicably coupled to one or more components of refrigeration system 100 (e.g., compressors 110, parallel compressors 120, gas cooler 130, expansion valve 140, flash tank 150, evaporator valves 160, evaporators 170, compressor valve(s) 180, and flash gas valve 190). As such, controller 105 may be configured to control the operations of one or more components of refrigeration system 100. For example, controller 105 may be configured to turn parallel compressor 120 on and off. As another example, controller 105 may be configured to open and close compressor valve(s) 180 and/or flash gas valve 190.

In some embodiments, controller 105 may further be configured to receive information about system 100 from one or more sensors 195. As an example, controller 105 may receive information about the ambient temperature of the environment from one or more sensors 195 (e.g., sensor 195*a* associated with gas cooler 130). As another example, controller 105 may receive information about the system load from sensor 195*b-c* associated with compressors 110 and/or sensors 195*d* associated with parallel compressors 120. As yet another example, controller 105 may receive information about the flash gas bypass flow rate from one or more sensors of refrigeration system 100 (e.g., sensor 195*e* associated with flash tank 150). In some embodiments, controller 105 determines whether to operate parallel compressor 120 based on information received from sensors 195. For example, controller 105 may determine whether to operate parallel compressor 120 by comparing the flow rate of refrigerant into parallel compressor 120 to a threshold. In certain embodiments, the flow rate of refrigerant into parallel compressor 120 may be determined at least in part based on the flash gas bypass flow rate sensed by sensor 195*e*.

As described above, controller 105 may be configured to provide instructions to one or more components of refrigeration system 100. Controller 105 may be configured to provide instructions via any appropriate communications link (e.g., wired or wireless) or analog control signal. As depicted in FIG. 1, controller 105 is configured to wirelessly communicate with components of refrigeration system 100. For example, in response to receiving an instruction from controller 105, parallel compressor 120 may begin operating. As another example, in response to receiving an instruction from controller 105, compressor 110*a* may increase discharge pressure. An example of controller 105 is further described below with respect to FIG. 4. In some embodiments, controller 105 includes or is a computer system.

In some embodiments, refrigeration system 100 includes one or more compressors 110. Refrigeration system 100 may include any suitable number of compressors 110. For example, as depicted in FIG. 1, refrigeration system 100 includes two compressors 110*a-b*. Compressors 110 may vary by design and/or by capacity. For example, some compressor designs may be more energy efficient than other compressor designs and some compressors 110 may have modular capacity (i.e., capability to vary capacity). As described above, compressor 110*a* may be a LT compressor that is configured to compress refrigerant discharged from a LT case (e.g., LT case 160*a*) and compressor 110*b* may be a MT compressor that is configured to compress refrigerant discharged from a MT case (e.g., MT case 160*b*).

In some embodiments, refrigeration system 100 includes a parallel compressor 120. Parallel compressor 120 may be configured to provide supplemental compression to refrigerant circulating through refrigeration system 100. For example, parallel compressor 120 may be operable to compress flash gas discharged from flash tank 150. As will be described in more detail below, parallel compressor 120 may also be operable to compress refrigerant discharged from LT compressor 110*a*. In some embodiments, discharging refrigerant from LT compressor 110*a* to parallel compressor 120 permits parallel compressor 120 to remain in operation for a longer duration than it would otherwise be able to if parallel compressor 120 only received flash gas from flash tank 150.

This disclosure recognizes that refrigeration system 100 may consume about 3.4% less energy by permitting parallel compressor 120 to compress refrigerant discharged by LT compressor 110*a* rather than limiting parallel compressor 120 to only compressing flash gas discharged from flash tank 150. This is because parallel compressors 120 are generally only operational when the flash gas flow is above a particular threshold (also referred to herein as "operation threshold").

As an example, a parallel compressor 120 in the traditional configuration may be operational so long as the flash gas bypass flow rate is above 50% of the design flow rate. The flash gas bypass flow rate may be dependent on one or more of the system load and/or the ambient temperature. As an example, in a transcritical system having a traditional configuration of parallel compressor 120, the parallel compressor may be configured to turn off when the ambient temperature is below a temperature threshold (e.g., 22° C.) and/or when the ambient temperature is below a temperature threshold (e.g., 24° C.) and the refrigeration load is below a load threshold (e.g., 80%). As will be understood by those of skill in the art, the temperature threshold may be based on the load of the refrigeration system.

This disclosure recognizes increasing the flow rate of refrigerant into parallel compressor 120 by directing refrigerant discharged from first compressor 110*a* to parallel compressor 120. In other words, this disclosure recognizes supplementing flash gas with refrigerant discharged from compressor 110*a* to increase the overall flow of refrigerant to parallel compressor 120. By increasing the overall flow of refrigerant to parallel compressor 120, parallel compressor 120 may be able to remain in operation for a longer duration relative to a refrigeration system having a parallel compressor in the traditional configuration. As a result, the disclosed configuration recognizes that parallel compressor 120 may remain in operation even at reduced ambient temperatures or reduced system loads. In other words, parallel compressor 120 in the disclosed configuration may operate at lower temperature and/or load thresholds than a parallel compressor 120 in the traditional configuration. For example, when the ambient temperature is 20° C. and the refrigeration load is 80% (compared to the traditional configuration where the parallel compressor shuts off when the ambient temperature is below 24° C. and the system load is 80%).

As depicted in FIGS. 1 and 2, refrigeration system 100 may include one or more gas coolers 130 in some embodiments. Gas cooler 130 is configured to receive compressed refrigerant vapor (e.g., from compressors 110, 120) and cool the received refrigerant. In some embodiments, gas cooler 130 is a heat exchanger comprising cooler tubes configured to circulate the received refrigerant and coils through which ambient air is forced. Inside gas cooler 130, the coils may absorb heat from the refrigerant, thereby providing cooling to the refrigerant. In some embodiments, refrigeration system 100 includes an expansion valve 140. Expansion valve 140 may be configured to reduce the pressure of refrigerant. For example, gas cooler 130 may discharge liquid refrigerant having a pressure of 120 bar to expansion valve 140, and the refrigerant may be discharged from expansion valve 140 having a pressure of 38 bar. In some embodiments, this reduction in pressure causes some of the refrigerant to vaporize. As a result, mixed-state refrigerant (e.g., refrigerant vapor and liquid refrigerant) is discharged from expansion valve 140. In some embodiments, this mixed-state refrigerant is discharged to flash tank 150.

Refrigeration system 100 may include a flash tank 150 in some embodiments. Flash tank 150 may be configured to receive mixed-state refrigerant and separate the received refrigerant into flash gas and liquid refrigerant. Typically, the flash gas collects near the top of flash tank 150 and the liquid refrigerant is collected in the bottom of flash tank 150. In some embodiments, the liquid refrigerant flows from flash tank 150 and provides cooling to one or more evaporates (cases) 160 and the flash gas flows to one or more compressors (e.g., compressor 110 and/or compressor 120) for compression before being discharged to gas cooler 130 for cooling.

Refrigeration system 100 may include one or more evaporators 160 in some embodiments. As depicted in FIGS. 1 and 2, refrigeration system 100 includes two evaporators 160 (LT case 160*a* and MT case 160*b*). As described above, LT case 160*a* may be configured to receive liquid refrigerant of a first temperature and MT case 160*b* may be configured to receive liquid refrigerant of a second temperature, wherein the first temperature (−29° C.) is lower in temperature than the second temperature (e.g., −7° C.). As an example, a LT case 160*a* may be a freezer in a grocery store and a MT case 160*b* may be a cooler in a grocery store. In some embodiments, the liquid refrigerant leaving flash tank 150 is the same temperature and pressure (e.g., 4° C. and 38 bar). Before reaching cases 160, the liquid refrigerant may be directed through one or more evaporator valves 170 (e.g., 170*a* and 170*b* of FIGS. 1 and 2). In some embodiments, each valve may be controlled (e.g., by controller 105) to adjust the temperature and pressure of the liquid refrigerant. For example, valve 170*a* may be configured to discharge the liquid refrigerant at −29° C. and 14 bar to LT case 160*a* and valve 170*b* may be configured to discharge the liquid refrigerant at −7° C. and 30 bar to MT case 160*b*. In some embodiments, each evaporator 160 is associated with a particular valve 170 and the valve 170 controls the temperature and pressure of the liquid refrigerant that reaches the evaporator 160.

System 100 may also include one or more compressor valves 180 in some embodiments. Compressor valves 180 may receive refrigerant discharged from first compressor 110*a* and may open and close to permit the received refrigerant to flow to either second compressor 110*a* or parallel compressor 110*b*. As depicted in FIG. 1, compressor valve 180 is a three-way valve permitting refrigerant to be discharged from first compressor 110*a* to either parallel compressor 120 or second compressor 110*b*. As depicted in FIG. 2, compressor valves 180*a-b* are solenoid valves permitting refrigerant to be discharged from first compressor 110*a* to second compressor 110*b* via compressor valve 180*a* or from first compressor 110*a* to parallel compressor 120 through compressor valve 180*b*.

In some embodiments, controller 105 controls the opening and closing of compressor valve(s) 180. The opening of compressor valve 180 may permit refrigerant to flow through valve 180 and the closing of compressor valve 180 may restrict refrigerant from flowing through valve 180. In some embodiments, controller 105 opens compressor valve 180 to permit flow through to parallel compressor 120 when parallel compressor 120 is operational. Parallel compressor 120 may be operational when the flow rate of refrigerant into parallel compressor 120 is above an operation threshold. As described above, the flow rate may fluctuate based on changes in the ambient temperature of the environment of the refrigeration system 100 and/or changes in the system load. As is also described above, directing refrigerant from compressor 110*a* to parallel compressor 120 increases the flow rate which permits parallel compressor 120 to remain in operation when it would otherwise not be (e.g., when the flow rate from flash tank 150 falls below the operation threshold due to the ambient temperature of the environment of the refrigeration system and/or the load of the refrigeration system).

Controller 105 may close compressor valve 180 to restrict flow through to parallel compressor 120 when parallel compressor 120 is not operational. In certain embodiments, parallel compressor 120 is non-operational when the ambient temperature is below a temperature threshold, the load is below a temperature threshold, and/or the flow rate of refrigerant into parallel compressor 120 falls below the operation threshold. In some embodiments, if compressor valve 180 is closed such that refrigerant cannot flow to parallel compressor 120, the refrigerant is instead directed to second compressor 110*a*.

System 100 may also include a flash gas valve 190 in some embodiments. Flash gas valve 190 may be configured to open and close to permit or restrict the flow through of flash gas discharged from flash tank 150. In some embodiments, controller 105 controls the opening and closing of flash gas valve 190. As depicted in FIGS. 1 and 2, closing flash gas valve 190 may restrict flash gas from flowing to second compressor 110*b* (such that the flash gas flows to parallel compressor 120) and opening flash gas valve 190 may permit flow of flash gas to second compressor 110*b*. As an example, controller 105 may close flash gas valve 190 when it determines to operate parallel compressor 120 and open flash gas valve 190 when it determines not to operate parallel compressor 120. As described above, determining to operate parallel compressor 120 may be based on a flow rate which may be increased by directing refrigerant from compressor 110*a* to parallel compressor 120.

This disclosure recognizes that refrigeration system 100 may comprise one or more other components. As an example, refrigeration system 100 may comprise one or more desuperheaters in some embodiments. One or ordinary skill in the art will appreciate that refrigeration system 100 may include other components not mentioned herein.

As described above, the disclosed configuration differs from a traditional configuration of a refrigeration system 100 with a parallel compressor 120 because it permits refrigerant discharged from first compressor 110*a* to be directed to parallel compressor 120. Refrigerant may be discharged from first compressor 110*a* to parallel compressor 120 when parallel compressor 120 is operational and may be discharged from first compressor 110*a* to second compressor 110*b* when parallel compressor 120 is not operational. This is in contrast to the traditional configuration wherein refrigerant discharged from first compressor 110*a* is directed to second compressor 110*b*. A similarity between the disclosed and the traditional configuration is that flash gas discharged from flash tank 150 is directed to either second compressor 110*b* or parallel compressor 120 based on whether parallel compressor 120 is operational.

In operation, controller 105 may determine whether parallel compressor 120 is operational. As described above, controller 105 operates parallel compressor 120 when the flow rate of refrigerant to the compressor is above an operation threshold and does not operate parallel compressor 120 when the flow rate is below the operation threshold (e.g., about 50% of design flow rate). The flow rate may fluctuate based on the ambient temperature of the environment of refrigeration system 100 and/or the load of refrigeration system 100. Thus, in some embodiments, controller 105 receives information about the flow rate from one or more sensors 195 (e.g., sensor 195*e* of flash tank 150) and, based on the received information, determines whether to operate parallel compressor 120.

If controller 105 determines to operate parallel compressor 120, controller 105 may direct refrigerant that is discharged from first compressor 110*a* to parallel compressor 120 for further compression. If controller 105 instead determines not to operate parallel compressor 120, controller 105 may direct refrigerant that is discharged from compressor 110*a* to first compressor 110*b* for further compression. In some embodiments, controller 105 directs refrigerant discharged from first compressor 110 to either parallel compressor 120 or second compressor 110*b* by opening and closing valve 180. As described above, valve 180 may be a three-way valve (e.g., valve 180 of FIG. 1) in some embodiments. In other embodiments, system 100 includes two solenoid valves (e.g., valve 180*a* and 180*b* of FIG. 2).

Controller 105 may also be configured to control the discharge pressure of refrigerant being compressed in compressor 110*a*. For example, if controller 105 determines to operate parallel compressor 120, controller 105 may control the discharge pressure of compressor 110*a* to substantially match the discharge pressure of flash gas leaving flash tank 150 (e.g., 38 bar). As another example, if controller 105 determines not to operate parallel compressor 120, controller 105 may control the discharge pressure of compressor 110*a* to substantially match the discharge pressure of flash gas leaving MT case 160*b* (e.g., 30 bar).

In addition to opening and closing compressor valve(s) 180 to permit or restrict flow to parallel compressor 120 from first compressor 110*a*, controller 105 may open and close flash gas valve 190 to permit or restrict flash gas flow to parallel compressor 120. In some embodiments, upon determining to operate parallel compressor 120, controller 105 opens compressor valve 180 to permit refrigerant to be discharged from first compressor 110*a* to parallel compressor 120 and closes flash gas valve 190 to prevent flash gas from flowing to second compressor 110*b*. As a result, the refrigerant discharged from first compressor 110*a* and the flash gas discharged from flash tank 150 are directed to parallel compressor 120 for compression. Thus, second compressor 110*b* may, in some embodiments, only compress refrigerant discharged from MT case 170*b* (rather than compressing refrigerant discharged from one or more of LT case 170*a* and flash tank 150 in addition to MT case 170*b*). This disclosure recognizes that refrigeration system 100 may keep parallel compressor in operation longer, relative to a traditional configuration, by permitting parallel compressor 120 to compress both flash gas discharged from flash tank 150 and refrigerant discharged from first compressor 110*a*.

In some embodiments, refrigerant from first compressor 110*a* is discharged directly to parallel compressor 120. In other embodiments, refrigerant from first compressor 110*a* is discharged indirectly to parallel compressor 120. As used herein, refrigerant is discharged "directly" to parallel compressor 120 when the refrigerant does not flow through other components (with the exception of compressor valve(s) 180) of refrigeration system 100. For example, as depicted in FIG. 1, refrigerant is discharged directly from first compressor 110*a* to parallel compressor 120. In contrast, as depicted in FIG. 2, refrigerant is discharged indirectly from first compressor 110*a* to parallel compressor 120. FIG. 2 illustrates that refrigerant may be discharged from first compressor 110*a* to flash tank 150, which in turn is discharged as flash gas from flash tank 150 to parallel compressor 120.

As described above, FIG. 3 illustrates a method 300 of a refrigeration system 100. In some embodiments, the method 300 may be implemented by controller 105 of refrigeration system 100. Method 300 may be stored on a computer readable medium, such as a memory of controller 105 (e.g., memory 420 of FIG. 4), as a series of operating instructions that direct the operation of a processor (e.g., processor 430 of FIG. 4). Method 300 may be associated with efficiency benefits such as reduced power consumption relative to refrigeration systems that operate a parallel compressor in a traditional configuration. In some embodiments, the method 300 begins in step 305 and continues to decision step 310.

At step 310, controller 105 determines whether a parallel compressor 120 of refrigeration system 100 is operational. In some embodiments, parallel compressor 120 is operational when a flow rate of refrigerant to parallel compressor 120 is greater than an operation threshold and is not operational when the flow rate is less than the operation threshold (e.g., about 50% of the design flow rate). The flow rate of refrigerant to parallel compressor 120 may refer to the present flow rate (e.g., if parallel compressor 120 is already operational) or the flow rate available to parallel compressor 120. For example, if parallel compressor 120 has been non-operational, the flow rate available from flash tank 150 and first compressor 110*a* may be sufficient to exceed the operation threshold and therefore to transition parallel compressor 120 from non-operational to operational. The flow rate may fluctuate based on an ambient temperature of the environment surrounding the refrigeration system and/or a load of the refrigeration system. For example, parallel compressor 120 may be operational as long as a temperature threshold (e.g., 15° C.) is met. As another example, parallel compressor 120 may be operational as long as a load threshold (e.g., 80%) is met.

If at step 310, controller 105 determines that parallel compressor 120 is operational (e.g., the present flow rate or available flow rate of refrigerant to parallel compressor 120 is greater than the operation threshold, the ambient temperature is greater than the temperature threshold, and/or the load is greater than a load threshold), the method 300 may proceed to step 320*a*. In contrast, if controller 105 determines that parallel compressor 120 is not operational at step 310, the method 300 proceeds to step 320*b*.

At step 320*a*, controller 105 directs refrigerant discharged from first compressor 110*a* to parallel compressor 120. In some embodiments, controller 105 directs refrigerant discharged from first compressor 110*a* to parallel compressor 120 by opening and closing one or more compressor valve (s) 180. For example, as depicted in FIG. 1, controller 105 may open three-way compressor valve 180 to permit the refrigerant from first compressor 110*a* to be discharged to parallel compressor 120. As another example, as depicted in FIG. 2, controller 105 may close compressor valve 180*a* and open compressor valve 180*b* to permit the refrigerant from first compressor 110*a* to be discharged to parallel compressor 120. In some embodiments (e.g., FIG. 1), refrigerant from first compressor 110*a* is discharged directly to parallel compressor 120. In other embodiments (e.g., FIG. 2), refrigerant from first compressor 110*a* is discharged indirectly to parallel compressor 120 (e.g., discharged from first compressor 110*a* to flash tank 150 and discharged from flash tank 150 to parallel compressor 120).

In some embodiments, directing the refrigerant from first compressor 110*a* to parallel compressor 120 increases the flow rate of refrigerant into parallel compressor 120, thereby permitting parallel compressor 120 to remain in operation for a longer duration relative to a refrigeration system 100 in the traditional configuration (e.g., wherein refrigerant from compressor 110*a* is not directed from compressor 110*a* to parallel compressor 120). In some embodiments, the refrigerant directed from compressor 110*a* to parallel compressor 120 has a discharge pressure that is substantially the same as the suction pressure of the parallel compressor.

If at decision step 310 controller 105 determines that parallel compressor 120 is not operational, the method 300 proceeds to step 320*b*. At step 320*b*, controller 105 directs the refrigerant discharged from first compressor 110*a* to second compressor 110*b*. Controller 105 may direct the refrigerant discharged from first compressor 110*a* by opening or closing one or more compressor valves 180. As an example, as depicted in FIG. 1, controller 105 may direct the refrigerant discharged from the first compressor 110*a* by opening three-way compressor valve 180 to permit the flow of refrigerant from first compressor 110*a* to second compressor 110*b* and closing three-way compressor valve 180 to restrict the flow of refrigerant from compressor 110*a* to parallel compressor 120. As another example, as depicted in FIG. 2, controller 105 may direct the refrigerant discharged from first compressor 110*a* by opening compressor valve 180*a* to permit the flow of refrigerant from first compressor 110*a* to second compressor 110*b* and closing compressor valve 180*b* to restrict the indirect flow of refrigerant from the first compressor 110*a* to parallel compressor 120 via flash tank 150. In some embodiments, the refrigerant directed from compressor 110*a* to second compressor 110*b* has a discharge pressure that is substantially the same as the suction pressure of second compressor 110*b*.

In some embodiments, after controller 105 directs the refrigerant from first compressor 110*a* to either parallel compressor 120 or second compressor 110*b*, the method 300 continues to an end step 325.

FIG. 4 illustrates an example controller 105 of refrigeration system 100, according to certain embodiments of the present disclosure. Controller 105 may comprise one or more interfaces 410, memory 420, and one or more processors 430. Interface 410 receives input (e.g., sensor data or system data), sends output (e.g., instructions), processes the input and/or output, and/or performs other suitable operation. Interface 410 may comprise hardware and/or software. As an example, interface 410 receives information about the ambient temperature of refrigeration system 100 and/or information about the load of the refrigeration system 100 from sensors 195. Controller 105 may compare the received temperature and load information to temperature and load thresholds to determine whether to operate parallel compressor 120. As described above, the flow rate of refrigerant to parallel compressor 120 is above an operation threshold when the temperature and/or load thresholds are met.

In some embodiments, if controller 105 determines that one or more of the temperature and load thresholds are met, controller 105 sends instructions to parallel compressor 120 to begin operating. Controller 105 may also send instructions to valves 180, 190 to open or close to permit the refrigerant from first compressor 110*a* and flash gas from flash tank 150 to be discharged to parallel compressor 120. For example, controller 105 may direct compressor valve 180 to open such that refrigerant from first compressor 110*a* is discharged to parallel compressor 120 for compression. As another example, controller 105 may direct flash gas valve 190 to close such that flash gas discharged from flash tank 150 is discharged to parallel compressor 120 for compression. Alternatively, if controller 105 determines that the one or more of the temperature and load thresholds are not met (based on a comparison of information from sensors 195), controller 105 may send instructions to parallel compressor 120 to terminate operation. Controller may also send instructions to valves 180, 190 to open or close such that the refrigerant discharged from first compressor 110*a* and flash gas discharged from flash tank 150 is directed to second compressor 10*b*.

Processor 430 may include any suitable combination of hardware and software implemented in one or more modules to execute instructions and manipulate data to perform some or all of the described functions of controller 105. In some embodiments, processor 430 may include, for example, one or more computers, one or more central processing units (CPUs), one or more microprocessors, one or more applications, one or more application specific integrated circuits (ASICs), one or more field programmable gate arrays (FPGAs), and/or other logic.

Memory (or memory unit) 420 stores information. As an example, memory 420 may store one or more of a temperature threshold, a load threshold, and an operation threshold. Controller 105 may use these stored thresholds to determine whether to operate parallel compressor 120. As another example, memory 420 may store the method 300. Memory 420 may comprise one or more non-transitory, tangible, computer-readable, and/or computer-executable storage media. Examples of memory 420 include computer memory (for example, Random Access Memory (RAM) or Read Only Memory (ROM)), mass storage media (for example, a hard disk), removable storage media (for example, a Compact Disk (CD) or a Digital Video Disk (DVD)), database and/or network storage (for example, a server), and/or other computer-readable medium.

Embodiments of the present disclosure may have one or more technical advantages. In certain embodiments, refrigeration system 100 permits refrigerant to be discharged from first compressor 110*a* to parallel compressor 120. Permitting refrigerant to be discharged from first compressor 110 to parallel compressor 120 may allow parallel compressor 120 to remain in operation longer than a refrigeration system with parallel compressors 120 in the traditional configuration (e.g., wherein the first compressor 110*a* is not configured to discharge refrigerant to parallel compressor 120). This may be due to the increase in the flow rate of refrigerant into parallel compressor 120 caused by supplementing the flash gas bypass flow rate from flash tank 150 with refrigerant discharged from first compressor 110*a*.

Increasing the flow rate permits parallel compressor 120 to remain in operation for a longer period of time than a refrigeration system having a parallel compressor in the traditional configuration. As an example, one embodiment of refrigeration system 100 having a MT load of 50 kW and a LT load of 20 kW may achieve an annual energy savings of about 3.4% by implementing the disclosed configuration rather than the traditional configuration in the refrigeration system. In such an embodiment, a parallel compressor in the disclosed configuration may permit the parallel compressor to operate when the load is 80% and/or when the ambient temperature of the refrigeration system is above 20° C. This is compared to a parallel compressor in the traditional configuration which permits the parallel compressor to operate when the load is 80% and the ambient temperature of the refrigeration system is above 24° C. and/or when the ambient temperature of the refrigeration system is above 22° C. Thus, the disclosed configuration permits the parallel compressor to operate at loads and/or ambient temperatures that the traditional configuration cannot operate at.

Modifications, additions, or omissions may be made to the systems, apparatuses, and methods described herein without departing from the scope of the disclosure. The components of the systems and apparatuses may be integrated or separated. Moreover, the operations of the systems and apparatuses may be performed by more, fewer, or other components. For example, refrigeration system 100 may include any suitable number of compressors, condensers, condenser fans, evaporators, valves, sensors, controllers, and so on, as performance demands dictate. One skilled in the art will also understand that refrigeration system 100 can include other components that are not illustrated but are typically included with refrigeration systems. Additionally, operations of the systems and apparatuses may be performed using any suitable logic comprising software, hardware, and/or other logic. As used in this document, "each" refers to each member of a set or each member of a subset of a set.

Modifications, additions, or omissions may be made to the methods described herein without departing from the scope of the disclosure. The methods may include more, fewer, or other steps. Additionally, steps may be performed in any suitable order.

Although this disclosure has been described in terms of certain embodiments, alterations and permutations of the embodiments will be apparent to those skilled in the art. Accordingly, the above description of the embodiments does not constrain this disclosure. Other changes, substitutions, and alterations are possible without departing from the spirit and scope of this disclosure.

The invention claimed is:

1. A transcritical refrigeration system operable to circulate refrigerant through the refrigeration system in order to provide refrigeration, the transcritical refrigeration system comprising:

a first compressor operable to compress refrigerant discharged from a first refrigeration case;

a second compressor operable to compress refrigerant discharged from a second refrigeration case;

a parallel compressor that, when operational, is operable to compress refrigerant discharged from a flash tank and provide parallel compression for the second compressor;

a three-way valve operable to direct the flow of refrigerant to one or more of the second compressor and the parallel compressor, wherein:

when operating in a first mode, the three-way valve permits the flow of refrigerant from the first compressor to the second compressor but does not permit the flow of refrigerant from the first compressor to the parallel compressor; and when operating in a second mode, the three-way valve permits the flow of refrigerant from the first compressor to the parallel compressor; and a controller operable to:

receive, from one or more sensors, information about a flow rate of the refrigerant;

operate the parallel compressor based on the flow rate of the refrigerant;

determine whether the parallel compressor is operational;

direct the refrigerant discharged from the first compressor to the second compressor, by instructing the three-way valve to operate in the first mode, if the parallel compressor is not operational; and direct the refrigerant discharged from the first compressor to the parallel compressor, by instructing the three-way valve to operate in the second mode, if the parallel compressor is operational.

2. The refrigeration system of claim 1, wherein:

the controller is operable to receive data about an ambient temperature of an environment surrounding the refrigeration system; and the parallel compressor is not operational when the ambient temperature of the environment is below a temperature threshold.

3. The refrigeration system of claim 1, wherein the controller is operable to receive data about a load of the refrigeration system; and the parallel compressor is not operational when the load of the refrigeration system is below a load threshold.

4. The refrigeration system of claim 1, wherein the parallel compressor is not operational when the flow rate of the refrigerant is below an operation threshold.

5. The refrigeration system of claim 1, wherein the refrigeration system is more efficient when the parallel compressor is operational than when the parallel compressor is not operational.

6. The refrigeration system of claim 1, wherein the controller directs the refrigerant discharged from the first compressor directly to the parallel compressor.

7. The refrigeration system of claim 1, wherein the refrigerant comprises carbon dioxide.

8. The refrigeration system of claim 1, wherein the refrigeration system further comprises the first refrigerated case and the second refrigerated case and the first refrigerated case is associated with a temperature that is lower than that of the second refrigerated case.

9. The refrigeration system of claim 1, wherein:

the refrigerant is discharged from the first compressor at a first discharge pressure when the parallel compressor is operational, the first discharge pressure being substantially similar to a suction pressure of the parallel compressor; and the refrigerant is discharged from the first compressor at a second discharge pressure when the parallel compressor is not operational, the second discharge pressure being substantially similar to a suction pressure of the second compressor.

10. A method for a refrigeration system, comprising:

receiving, from one or more sensors of the refrigeration system, information about a flow rate of refrigerant circulating through the refrigeration system;

operating a parallel compressor of the refrigeration system based on the flow rate of the refrigerant;

determining whether the parallel compressor is operational;

directing the refrigerant discharged from a first compressor of the refrigeration system to a second compressor of the refrigeration system, by instructing a three-way valve of the refrigeration system to operate in a first mode, if the parallel compressor is not operational;

directing the refrigerant discharged from the first compressor to the parallel compressor, by instructing the three-way valve to operate in a second mode, if the parallel compressor is operational;

wherein:

the first compressor is operable to compress refrigerant discharged from a first refrigeration case;

the second compressor is operable to compress refrigerant discharged from a second refrigeration case; and the parallel compressor, when operational, is operable to compress refrigerant discharged from a flash tank and provide parallel compression for the second compressor;

the three-way valve permits the refrigerant to flow from the first compressor to the second compressor but does not permit the refrigerant to flow from the first compressor to the parallel compressor when operating in the first mode; and the three-way valve permits the refrigerant to flow from the first compressor to the parallel compressor when operating in the second mode.

11. The method of claim 10, wherein the refrigerant comprises carbon dioxide.

12. The method of claim 10, the method further including:

receiving data about an ambient temperature of an environment surrounding the refrigeration system, wherein the parallel compressor is not operational when the ambient temperature of the environment is below a temperature threshold.

13. The method of claim 10, the method further including:

receiving data about a load of the refrigeration system, wherein the parallel compressor is not operational when the load of the refrigeration system is below a load threshold.

14. The method of claim 10, wherein the parallel compressor is not operational when the flow rate of refrigerant is below an operation threshold.

15. The method of claim 10, wherein:

the refrigerant is discharged from the first compressor at a first discharge pressure when the parallel compressor is operational, the first discharge pressure being substantially similar to a suction pressure of the parallel compressor; and the refrigerant is discharged from the first compressor at a second discharge pressure when the parallel compressor is not operational, the second discharge pressure being substantially similar to a suction pressure of the second compressor.

16. A controller for a refrigeration system, the controller comprising one or more processors and logic encoded in non-transitory computer readable memory, the logic, when executed by one or more processors, operable to:

receive, from one or more sensors of the refrigeration system, information about a flow rate of refrigerant circulating through the refrigeration system;

operate a parallel compressor of the refrigeration system based on the flow rate of the refrigerant;

determine whether the parallel compressor is operational;

direct the refrigerant discharged from a first compressor of the refrigeration system to a second compressor of the refrigeration system, by instructing a three-way valve of the refrigeration system to operate in a first mode, if the parallel compressor is not operational;

direct the refrigerant discharged from the first compressor to the parallel compressor, by instructing a three-way valve of the refrigeration system to operate in a second mode, if the parallel compressor is operational;

wherein:

the first compressor is operable to compress refrigerant discharged from a first refrigeration case;

the second compressor is operable to compress refrigerant discharged from a second refrigeration case;

the parallel compressor, when operational, is operable to compress refrigerant discharged from a flash tank and provide parallel compression for the second compressor;

the three-way valve permits the refrigerant to flow from the first compressor to the second compressor but does not permit the refrigerant to flow from the first compressor to the parallel compressor when operating in the first mode; and the three-way valve permits the refrigerant to flow from the first compressor to the parallel compressor when operating in the second mode.

17. The controller of claim 16, wherein:

the refrigerant is discharged from the first compressor at a first discharge pressure when the parallel compressor is operational, the first discharge pressure being substantially similar to a suction pressure of the parallel compressor; and the refrigerant is discharged from the first compressor at a second discharge pressure when the parallel compressor is not operational, the second discharge pressure being substantially similar to a suction pressure of the second compressor.

18. The controller of claim 16, wherein the logic, when executed by one or more processors, operable to is further operable to:

receive data about an ambient temperature of an environment surrounding the refrigeration system; and prevent the parallel compressor from operating when the ambient temperature of the environment is below a temperature threshold.

19. The controller of claim 16, wherein the logic, when executed by one or more processors, operable to is further operable to:

Receive data about a load of the refrigeration system; and prevent the parallel compressor from operating when the load of the refrigeration system is below a load threshold.

* * * * *